United States Patent [19]

Cardamone

[11] 4,195,728

[45] Apr. 1, 1980

[54] PACKAGING SYSTEMS

[75] Inventor: Tom Cardamone, New York, N.Y.

[73] Assignee: Keyline Research & Development Corp., Rutherford, N.J.

[21] Appl. No.: 911,160

[22] Filed: May 31, 1978

[51] Int. Cl.[2] ..... B65D 25/28; B65D 65/18

[52] U.S. Cl. ..... 206/45.33; 206/497; 220/4 B; 220/23.86; 220/94 R

[58] Field of Search ..... 220/94 B, 94 R, 4 E, 220/4 B, 23.83, 23.86; 206/497, 45.33, 45.31, 45.34

[56] References Cited

U.S. PATENT DOCUMENTS

| | | | |
|---|---|---|---|
| 1,268,124 | 6/1918 | Jennings | 220/94 R |
| 3,305,076 | 2/1967 | Fleenor | 220/94 R |
| 3,310,905 | 3/1967 | Davis et al. | 220/4 B X |
| 3,334,714 | 8/1967 | Gordon | 220/94 R |
| 3,768,393 | 10/1973 | Betz et al. | 220/4 B X |
| 3,885,667 | 5/1975 | Spiegel et al. | 206/45.33 |
| 4,036,362 | 7/1977 | Ullman | 206/497 X |

*Primary Examiner*—Joseph Man-Fu Moy
*Attorney, Agent, or Firm*—Le Blanc, Nolan, Shur & Nies

[57] ABSTRACT

Packaging systems composed of one or more containers in an outer receptacle fabricated from a synthetic material. Unique features of the system make it economical, facilitate its handling, manufacturing, and assembly; make it possible to stack like assemblies into stable aggregations with a minimum of wasted space; and provide other advantages including, but not limited to, protection and positive positioning of the container(s) in the receptacle and areas for display advertising on both the container(s) and the receptacles which are visible from the exterior of the outer receptacle.

7 Claims, 5 Drawing Figures

PACKAGING SYSTEMS

The present invention relates to packaging systems and, more specifically, to novel, improved packaging systems which include a product container in an outer receptacle.

The principles of the present invention are particularly adaptable to applications involving the packaging of multiple, liquid tight containers in one outer receptacle or container; and they will consequently be developed in reference to that application for the sake of convenience, clarity, and compliance with the first paragraph of 35 USC 112. This, however, is not intended to in any way restrict the scope of protection to which I consider myself entitled, it being my intention to limit such protection only in accord with the breadth of the claims appended hereto.

The outer receptacles of my novel packaging systems, which can be economically fabricated of a light, strong material such as an expanded polystyrene, are preferably parallelpipeds with rectangular faces which make them easy to assemble into stable stacks having a minimum of wasted space. These receptacles are composed of two components having a tongue-and-groove aligning arrangement, making them economical to fabricate and assemble and facilitating the assembling of the container or containers in the receptacle.

Appropriately configured projections or buttresses extending inwardly from the walls of the outer receptacle positively position the associated container or containers in the receptacle, thereby protecting the latter against forces which might result in rupture of a container and consequent leakage of its contents. An aperture in the top wall of the outer container gives access to a handle at the upper end of a container in the package. This novel arrangement permits both the unpackaged container and the container/receptacle assemblage to be handled by a single member, simplifying and reducing the cost of packaging containers of the character disclosed herein. Furthermore, by containing the upper end of the handle within the confines of the receptacle upper wall, the obstacle to close stacking presented by the typical protruding handle of conventional packaging can be eliminated.

One important and primary object of the present invention resides in the provision of novel, improved packaging systems which have an outer receptacle and one or more containers housed therein.

Other important but more specific objects of my invention reside in the provision of packaging systems in accord with the preceding object:

(1) which are particularly adaptable to the packaging of liquid tight containers;

(2) in which, in conjunction with the preceding object, the outer receptacle is constructed to cushion and otherwise protect the container(s) housed therein against such damage as might lead to a ruptured container and consequent leakage of liquid;

(3) which can be economically fabricated of a light, strong material;

(4) in which, in conjunction with the preceding object, the outer receptacle is composed of readily molded and easily assembled components;

(5) in which, in conjunction with object no. 3, the components of the outer receptacle are maintained in assembled relationship in a simple, inexpensive fashion;

(6) which are so designed and constructed that advertising and/or other printed material on both the outer receptacle and the container(s) therein is readily visible from the exterior of the assemblage;

(7) which can be stacked with a minimum of wasted space;

(8) in which, in conjunction with the preceding object, the outer receptacle has essentially the configuration of a parallelpiped with rectangular faces and is free of protuberances;

(9) in which a handle on an inner container is accessible from the exterior of the outer receptacle and can accordingly be employed to handle both the container(s)-receptacle assemblage and the container after the latter is unpackaged;

(10) which have various combinations of the foregoing attributes.

Other important objects and features and additional advantages of my invention will become apparent from the appended claims and as the ensuing detailed description and discussion proceeds in conjunction with the accompanying drawing, in which:

Figure 1:
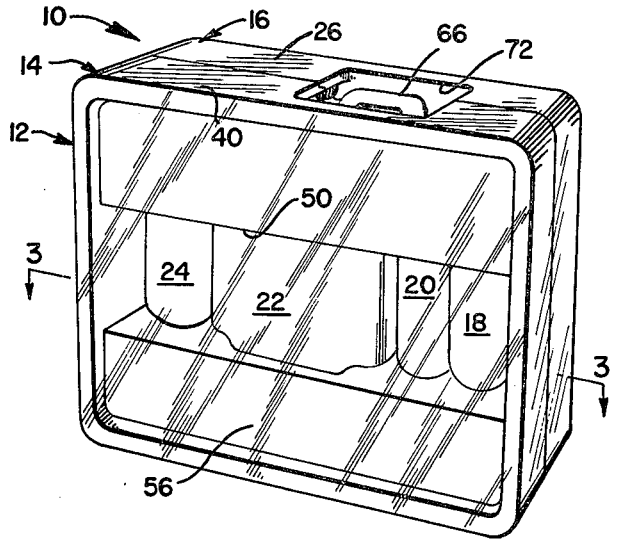
FIG. 1 is a perspective view of a packaging system embodying and constructed in accord with the principles of the present invention.
Figure 2:
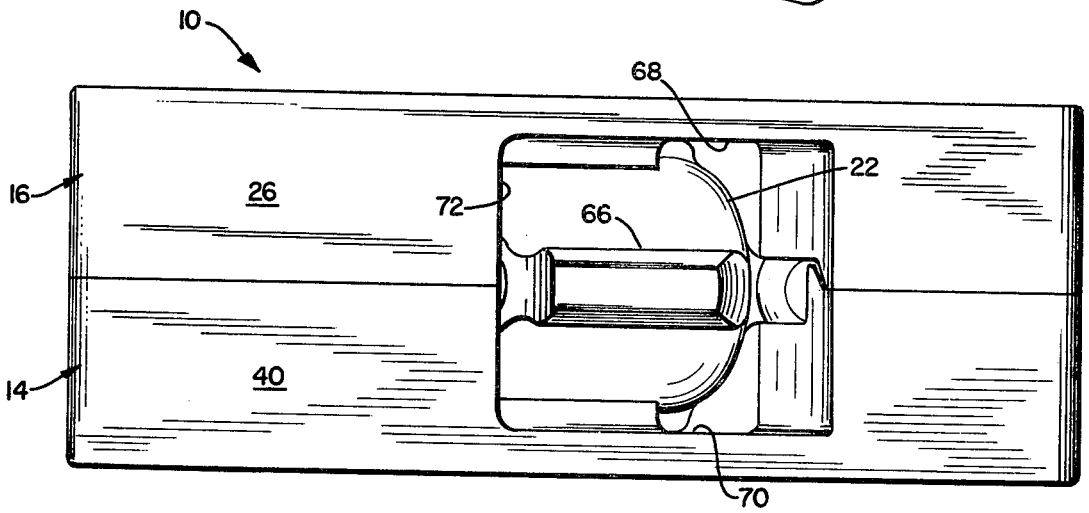
FIG. 2 is a top view of the packaging system.

Referring now to the drawing, FIGS. 1 and 2 depict a packaging system 10 embodying and constructed in accord with the principles of the present invention. In the illustrated embodiment this system includes an outer receptacle 12 composed of front and rear components 14 and 16. The overall configuration of outer receptacle 12 is that of a parallelpiped. Packaging systems such as those identified by reference character 10 can, as a consequence, be made into stacks which are stable and which have a minimum of waste space.

Housed in receptacle 12 are liquid tight inner containers 18, 20, 22, and 24. In one exemplary application of the invention the largest inner container 22 holds 4.5 quarts of motor oil; container 24 holds 32 ounces of engine flush; and containers 18 and 20 hold, respectively, 16 ounces of engine oil additive and 8 ounces of transmission fluid additive.

The two components 14 and 16 of outer receptacle 12 are of similar configuration, and both are fabricated from expanded polystyrene in the illustrated exemplary embodiment of the invention.

As can be seen from FIGS. 1–4, component 16 has upper and lower walls 26 and 28 and side walls 30 and 32, all extending normally from rear wall 34. A juxtaposed tongue 36 and groove 38 extend continuously around the periphery of the component at the free edges of walls 26, 28, 30, and 32.

The similarly constructed front component 14 of outer receptacle 12 has top (or upper) and bottom (or lower) walls 40 and 42 and side walls 44 and 46 extending normally from a front wall 48. An opening 50 in the front wall extends essentially from one of the two side walls 44 and 46 to the other side wall. This opening exposes portions of inner containers 18, 20, 22, and 24 as can best be seen in FIG. 1 and makes advertising material or other information on the inner containers visible from the exterior of outer receptacle 12. Additional information can be displayed on the front wall itself above and below opening 50.

Figure 3:
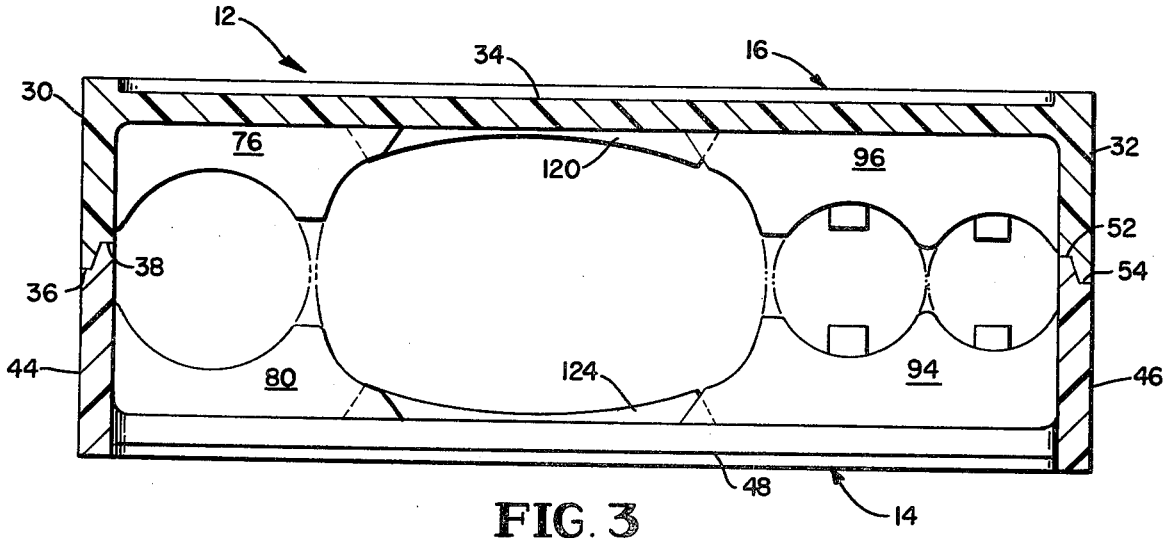
FIG. 3 is a section through the outer container of the packaging system taken substantially along line 3—3 of FIG. 1.

The front component 14 of outer package 12 has a peripherally continuous tongue 52 and a groove 54 which complement those of component 16, the two tongue-and-groove sets thereby positively locating one outer container component relative to the other when they are assembled together as shown in FIGS. 1-3.

The two outer receptacle components are preferably maintained in the illustrated, assembled relationship by shrink wrapping a transparent, polymeric film 56 around the assembled packaging system (see FIG. 1).

Before components 14 and 16 are assembled, the inner containers are installed in one of them, the other component then being fitted in place. The housing of the containers in the outer receptacle is thereby easily and rapidly accomplished.

The three smaller, inner containers are of conventional, cylindrical configuration, access being furnished to their interiors by screw caps 58, 60, and 62 (see FIGS. 1 and 3). The largest container 22 has a cross section resembling that of an ellipse with truncated ends and a screw cap 64 and a carrying handle 66 at the upper end thereof.

Figure 4:
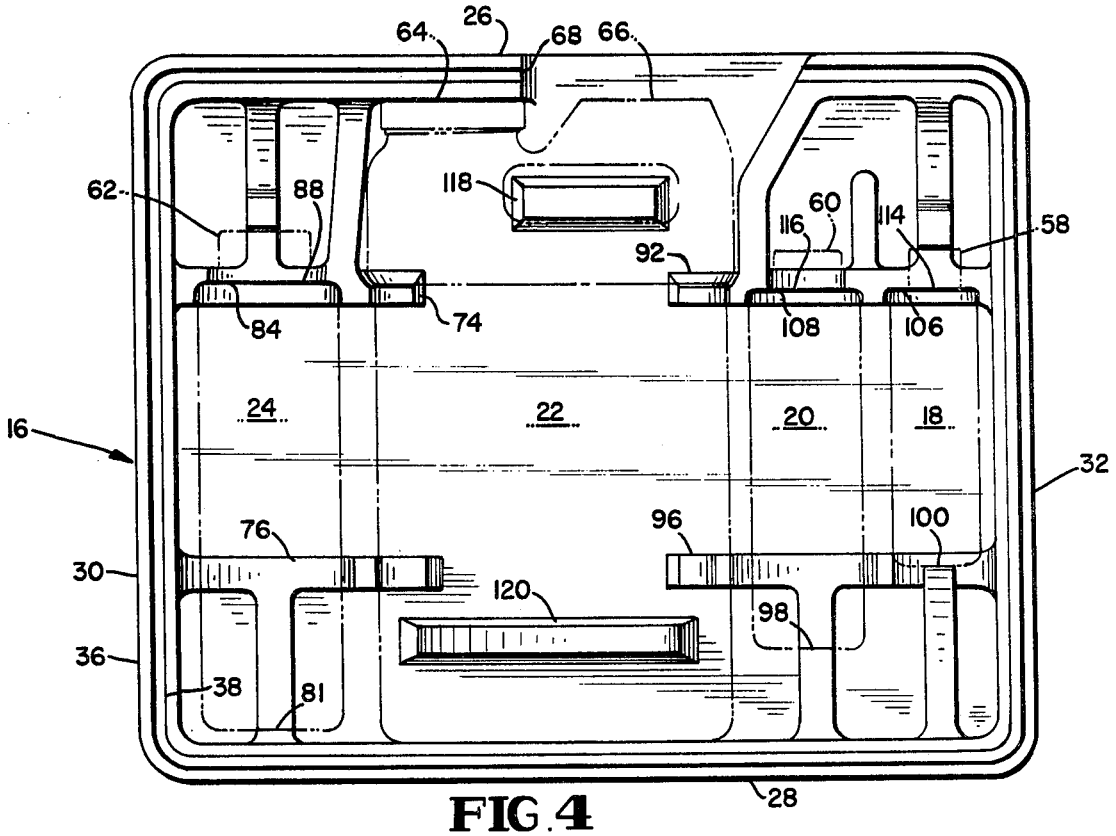
FIG. 4 is an elevation showing the interior of one of two components making up the outer container or receptacle of the system.
Figure 5:
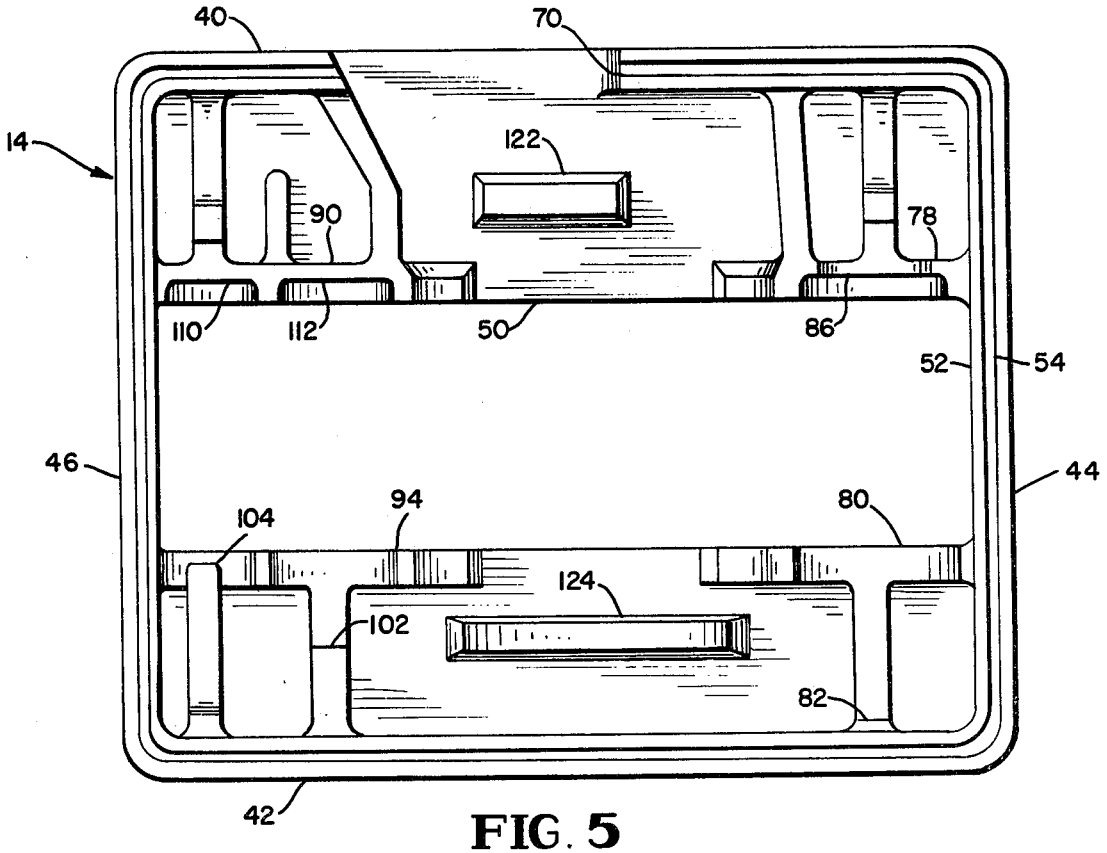
FIG. 5 is a similar view of the other of the components making up the outer container of the system.

As shown in FIGS. 1, 2, and 4, cooperating recesses 68 and 70 in the top walls 26 and 40 of outer receptacle components 16 and 14 form a rectangular opening 72 in receptacle 12 in alignment with the handle 66 of inner container 22. This makes that handle accessible from the exterior of the outer container so that it thereby serves as a handle for both inner container 22 and the entire packaging system 10. This handle lies entirely within the confines of the top wall and consequently does not interfere with the stacking of packaging systems 10.

The four inner containers 18, 20, 22, and 24 are fixedly positioned in outer receptacle 12 by a system of buttresses. These are integral with and extend toward the interior of the outer receptacle from the rear wall 34 of component 16 and the front wall 48 of component 14.

More particularly, upper and lower buttresses 74 and 76 of component 16; and upper and lower buttresses 78 and 80 of component 14 have arcuate portions (only the lower ones are shown, see FIG. 3) which engage the opposite sides of and position container 24 laterally in receptacle 12. This container is located vertically by a step 81 adjacent the lower or bottom wall 28 of component 16 and a similarly located step 82 in component 14 and by ledges 84 and 86 of buttresses 74 and 78, which engage a shoulder 88 at the upper end of the container.

Containers 18 and 20 are similarly located laterally in receptacle 12 by arcuate portions of upper buttresses 90 and 92 and lower buttresses 94 and 96. Steps 98 and 100 in component 16 cooperate with similar steps 102 and 104 on vertical buttresses in component 14 to support the lower ends of containers 18 and 20. These inner containers are held against the steps just described by cooperating ledges 106 and 108 in component 16 and 110 and 112 in component 14. They engage shoulders 114 and 116 at the upper ends of containers 18 and 20, respectively.

The largest container 22 extends between and is positioned vertically by the upper walls 26 and 40 and lower or bottom walls 28 and 42 of outer receptacle components 14 and 16. It is positioned laterally by cooperating upper and lower buttresses 118 and 120 in component 16 and 122 and 124 in component 14.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A packaging system comprising: an assemblage of a receptacle including abutted front and rear members configured to provide a hollow enclosure completely surrounded by portions of said front and rear members; a liquid tight container disposed in said enclosure, said container including a handle and there being an aperture in said receptacle through which said handle can be reached, whereby said assemblage can be carried by the handle of said container, and means uniting said front and rear members which is rupturable to make said members separable and thereby make the container removable from the receptacle.

2. A packaging system according to claim 1 which has a plurality of additional, liquid tight containers disposed in said enclosure in vertically oriented, side-by-side relationship with the container which has the handle and in which the receptacle has a bottom wall relative to which said containers are adapted to be positioned and front and back walls, said front and back walls being, respectively, elements of said front and back receptacle members and there being means projecting inwardly from said front and back walls which confine said containers therebetween and which hold said containers against movement relative to the bottom wall of said receptacle.

3. A packaging system according to claim 1 which includes means for aligning the front and rear members of the receptacle including a tongue and groove extending around periphery of the top, bottom, and side wall forming portions of one of said members and a tongue and groove of complementary configuration extending around the periphery of top, bottom, and side wall forming portions of the other of said members, one of said grooves opening onto the exterior of the receptacle and the other of said grooves opening onto the enclosure in said receptacle.

4. A packaging system as defined in claim 1 wherein said receptacle members have front and back walls bounding the enclosure in which the container is disposed, wherein there is an aperture in one of said walls through which said container can be viewed, and wherein the means uniting the front and rear members of the receptacle is a transparent film spanning said aperture.

5. A packaging system according to claim 4 together with front wall portions above and below said aperture which are adapted to have advertising and/or other printed material thereon.

6. A packaging system according to claim 1 in which said receptacle is essentially a parallelpiped with all six faces meeting at right angles and in which said handle is confined with the bounds of the parallelpiped, thereby facilitating the stacking of systems as aforesaid into stable aggregations of minimum volume.

7. A packaging system according to claim 1 in which said receptacle is fabricated entirely from an expanded synthetic resin.

* * * * *